US007785684B2

(12) United States Patent
Halle

(10) Patent No.: US 7,785,684 B2
(45) Date of Patent: Aug. 31, 2010

(54) WINDOW TRIM APPARATUS

(75) Inventor: John Halle, Ladera Ranch, CA (US)

(73) Assignee: Trimquick Company, Norco, CA (US)

( * ) Notice: Subject to any disclaimer, the term of this patent is extended or adjusted under 35 U.S.C. 154(b) by 412 days.

(21) Appl. No.: 11/704,468

(22) Filed: Feb. 9, 2007

(65) Prior Publication Data

US 2008/0003393 A1 Jan. 3, 2008

Related U.S. Application Data

(60) Provisional application No. 60/818,189, filed on Jun. 30, 2006.

(51) Int. Cl.

| | |
|---|---|
| ***B32B 9/00*** | (2006.01) |
| ***B32B 3/00*** | (2006.01) |
| ***B32B 3/28*** | (2006.01) |
| ***G09F 3/00*** | (2006.01) |

(52) U.S. Cl. ..... 428/40.1; 428/42.1; 428/43; 428/156; 428/167

(58) Field of Classification Search ..... 428/40.1, 428/42.1, 43, 167, 480, 906; 225/1, 2
See application file for complete search history.

(56) References Cited

U.S. PATENT DOCUMENTS

| | | | | |
|---|---|---|---|---|
| 4,537,809 | A * | 8/1985 | Ang et al. | 428/42.2 |
| 7,220,472 | B2 | 5/2007 | Rivest | |
| 2007/0020425 | A1 * | 1/2007 | Rivest | 428/40.1 |

OTHER PUBLICATIONS http://web.archive.org/web/20040205011309/http://www.trimquick.com, Feb. 2, 2004, Home page.* http://web.archive.org/web/20040205011309/http://www.trimquick.com, Feb. 2, 2004, TrimQuick Product Details.*

TrimQuick brochure, (Indicating "Marketed Aug. 15, 2005").

* cited by examiner

*Primary Examiner*—Patricia L Nordmeyer
(74) *Attorney, Agent, or Firm*—Stout, Uxa, Buyan & Mullins; Carlos A. Fisher

(57) ABSTRACT

Window trim apparatuses are provided that include scored grooves made by methods other than extrusion. Also provided are methods and apparatuses for manufacturing and using same.

18 Claims, 3 Drawing Sheets

WINDOW TRIM APPARATUS

RELATED APPLICATIONS

This application claims priority to U.S. Provisional Application Ser. No. 60/818,189, filed on Jun. 30, 2006, the entire contents of which are incorporated herein by this reference.

FIELD OF THE INVENTION

The present invention relates to window trim and methods for making and using same. In a particular embodiment, the invention relates to window trim with scored grooves structured to provide window trim that can be more easily made to fit a desired window size, preexisting window frame, or wall space surrounding a preexisting window without requiring the installer to utilize specialized cutting instruments. In other aspects, the invention includes methods for making and using same.

BACKGROUND OF THE INVENTION

Homeowners and builders seeking to renovate or restore existing homes often wish to alter the existing windows or window frames. In some cases the old decorative portion of the window frame is removed or replaced, either as a consequence of replacing a window, or simply in order to renovate the "look" of an old window. In such cases the window is mounted into an existing (or similar) structural portion of the window frame, leaving a gap between the mounted window and this structural portion of the frame (usually made of metal such as steel or aluminum alloys) into which it is mounted.

Such a resulting gap can be non-uniform, such that it is larger on one side or another, or at the top or bottom. While installers may be able to center the windows during installation, an aesthetically acceptable centering is not always possible. Additionally, the gap at the top of the window is often wider than the gap at the bottom, and centering from top to bottom is more difficult.

As one way of improving the cosmetic appeal of such window installations or window frames and filling the gaps between windows and structural frames installers have used flat polymeric window trim strips to cover the gaps between window and frame. These flat window trim strips may optionally have an adhesive such as an adhesive strip on one side permitting them to be affixed to the underlying metal structural window frame thereby covering or filling the gaps, and are attractively colored or patterned on the front visible decorative surface.

Because the gaps vary in size, manufacturers sell a range of window trim in different widths, which can be used as-is, or cut down to the desired width in the field by the installer. Cutting down a wider trim to the desired width is often preferred by the installers to keeping multiple different widths in inventory. However, the time, inconvenience and skill required to make a uniform cut into a window trim strip can lead to waste, added expense, and aesthetically variable lack of uniformity for the homeowner.

Currently, customizable trim is made by extruding polyvinyl chloride (or a similar polymeric material) through an extrusion die having one or more small tooth on one interior surface. This die thus creates shallow furrows on the bottom surface of the trim; these furrows can then be used as guides for a knife used to cut the trim. However, die-formed furrows have a number of drawbacks, including the potential for accidents resulting from the knife slipping on the trim strip, or sore hands resulting from trying to snap the trim apart after scoring it with the knife. Additionally, the use of extrusion dies to form such grooves produces shrink lines on the side of the trim opposite to the furrows, due to uneven shrinkage of the extruded polymeric material after the extrudate cools down. Such shrink lines are visible on the exposed ("front") side of the trim after installation, which is aesthetically undesirable. However, there is a trade off in using such furrowed trim strips: the deeper the furrows are (and thus, the easier to cut the trim is), the more prominent the shrink lines on the front surface become.

Accordingly, there is a need in the art for customizable polymeric trim that is easy to cut to a necessary width in the field, but is smooth on the top surface so as to remain aesthetically pleasing. Additionally there is a desire among installers for a trim strip that is faster to install, less dependent on specialized equipment, and which results in less waste and greater aesthetic predictability.

In addition, there is a desire among manufacturers of polymeric window trim for improved methods for making polymeric window trim stripping which is customizable, uniform easy to cut, and smooth on the front surface so as to remain aesthetically pleasing. Such manufacturers particularly value manufacturing methods that have at least one advantage which may include: product uniformity from lot to lot, low cost of manufacture, relatively low equipment capitalization costs through the use of largely pre-existing equipment and materials, and relative simplicity of manufacture.

SUMMARY OF THE INVENTION

In one embodiment, the invention provides a polymeric window trim apparatus comprising a substantially flat, elongated polymeric window trim element having a front surface and an opposing back surface and at least one longitudinally extending groove on at least one such surface formed by a stationary blade after extrusion.

In another embodiment, the window trim apparatus comprises a plurality of longitudinally extending grooves (e.g., two, three, four, five or more grooves). In a preferred embodiment, the grooves are substantially straight and substantially parallel. In another preferred embodiment, the surface opposite to the longitudinally extending grooves is substantially smooth. Preferably, the grooves are located on the back surface of the trim apparatus, and the substantially smooth surface is located on the front surface.

In another embodiment, at least two of the longitudinally extending grooves have different depths with respect to each other. Preferably, at least three of the longitudinally extending grooves have different depths with respect to each other. Even more preferably, all of the longitudinally extending grooves have different depths with respect to each other.

In a further embodiment, the window trim apparatus comprises at least two longitudinally extending grooves, wherein the depth of each such groove decreases proportionally to its distance from a proximal edge of the window trim apparatus.

In one embodiment, at least one longitudinally extending groove has a depth of about 80-90%, 70-79%, 60-69%, 50-59%, 40-49%, 30-39%, 20-29% or 10-19% of the thickness of the window trim apparatus. In this context "thickness" means the dimension (commonly expressed in inches) of the window trim apparatus extending between the front surface and the bottom surface.

In another embodiment, the window trim apparatus comprises at least one longitudinally extending groove having a depth of about ⅔ the thickness of the window trim apparatus. In another embodiment, the window trim comprises at least one longitudinally extending groove having a depth of about ½ the thickness of the window trim apparatus. In another embodiment the window trim comprises at least one longitudinally extending groove having a depth of about ⅓ the thickness of the window trim apparatus. In a particularly preferred embodiment the window trim apparatus has at least two longitudinally extending grooves in which the depth of each groove decreases as a function of its distance from a proximal edge of the trim apparatus.

In a particularly preferred embodiment of the window trim apparatus, a first longitudinally extending groove has a depth of about ½ the thickness of the window trim apparatus, a second longitudinally extending groove has a depth of about ½ the thickness of the window trim apparatus, and a third longitudinally extending groove has a depth of about ⅓ the thickness of the window trim apparatus. In an even more preferred aspect of this embodiment, the first groove is closest of the grooves to a proximal edge of the window trim apparatus, the third groove is the distalmost of the grooves to the proximal edge of the window trim apparatus, and the second groove is located between the first and third grooves. Preferably, all the longitudinally extending grooves are substantially straight and substantially parallel to each other and to the proximal edge of the window trim apparatus.

In another embodiment, the distance between a proximal edge of the window trim apparatus and at least one longitudinally extending groove is about 10-19%, or about 20-29%, or about 30-39%, or about 40-50% of the total width of the window trim apparatus.

In another embodiment, the invention provides a window trim apparatus that comprises at least one substantially straight longitudinally extending groove, wherein said longitudinally extending groove is located about 1/7 of the width of the window trim apparatus from a proximal edge of the window trim apparatus and substantially parallel to said edge. In another embodiment of the invention, said longitudinally extending groove is spaced about 2/7 of the width of the window trim apparatus from a proximal edge of the window trim apparatus, and substantially parallel to said edge. In another embodiment of the invention, said longitudinally extending groove is spaced about 3/7 of the width of the window trim apparatus from a proximal edge of the window trim apparatus, and substantially parallel to said edge. Preferably the window trim apparatus, wherein a first groove is located, apparatus of these embodiments comprises at least two longitudinally extending, substantially parallel grooves, wherein the third longitudinally extending groove is spaced about 3/7 of the width of the window trim apparatus from the same edge of the window trim apparatus. In a preferred embodiment, the window trim apparatus comprises three substantially straight longitudinally extending grooves, wherein a first groove is located about 1/7 inch of the width of the window trim apparatus from a proximal edge of the apparatus, a second groove is located about 2/7 inch of the width of the window trim apparatus from a proximal edge of the apparatus, and a third groove is located about 3/7 inch of the width of the window trim apparatus from a proximal edge of the apparatus, and wherein the grooves are substantially parallel to each other.

In another embodiment, the window trim apparatus of the invention is about 1/16 of an inch thick. In either the same or another embodiment, the window trim apparatus is about 1¾ inches wide. In yet another embodiment, the window trim apparatus comprises three substantially parallel longitudinally extending grooves, wherein at least one longitudinally extending groove is about 0.015 inches deep. In another embodiment, at least one longitudinally extending groove is about 0.025 inches deep. In another embodiment, at least one longitudinally extending groove is about 0.040 inches deep. In a further embodiment, the window trim apparatus comprises a first, a second, and a third substantially parallel longitudinally extending groove, wherein the first groove is about 0.04 inches deep, the second groove is about 0.025 inches deep, and the third groove is about 0.015 inches deep.

In still another embodiment, the window trim apparatus comprises three substantially parallel longitudinally extending grooves, wherein the first longitudinally extending groove is spaced about ¼ of an inch from one edge, wherein the second longitudinally extending groove is spaced about ½ of an inch from the same edge, and wherein the third longitudinally extending groove is spaced about ¾ of an inch from the same edge. In other embodiments, the window trim apparatus comprises at least one groove spaced a distance from a proximal edge of said trim selected from the group consisting of about ¼ inch, about ½ inch, and about ¾ of an inch.

In another embodiment, the window trim apparatus of the invention comprises a polymeric composite material. In another embodiment, the window trim apparatus comprises a color component; in a preferred aspect of this embodiment, the color component causes the window trim apparatus to have a white color. In another embodiment, the window trim apparatus comprises a polyvinyl chloride (PVC) component. In yet another embodiment, the window trim apparatus comprises a titanium dioxide component.

In another embodiment, the window trim apparatus of the invention comprises a protective liner on a side of the apparatus. Preferably, the protective liner is located on the side opposite to the side comprising the longitudinally extending grooves. In another embodiment, the protective liner is selected from a paper component and a polymeric film. The polymeric film may comprise any suitable polymer, and may, without limitation, be selected from the group consisting of a polyethylene component, a polypropylene component, a polycarbonate component and polyacrylate component. In one embodiment, the protective liner comprises a polymeric film comprising a polyethylene component. In another embodiment, the protective liner is about 1-5 mil thick. In a further embodiment, the protective liner is about 2 mil thick. In a preferred embodiment, the protective liner is removable from the surface of the window trim apparatus.

In another embodiment, the window trim apparatus of the invention comprises an adhesive component preferably located on a side of the trim apparatus opposite to that of the protective layer. Even more preferably, the window trim apparatus is located between at least one longitudinally extending groove and one edge of the window trim apparatus. In a preferred embodiment, the adhesive component is located in a region of said surface that is free of longitudinally extending grooves.

In one embodiment, the adhesive component is extruded onto the trim during manufacture of the trim. In another embodiment, the adhesive is 0.001-0.20 inches thick. In another embodiment, the adhesive is about 0.10 inches thick. In another embodiment, the adhesive component comprises a pre-fabricated adhesive sheet affixed to one side of the window trim apparatus. In another embodiment, the adhesive comprises a rubber component, preferably a vulcanized rubber component. In a further embodiment, the adhesive component of the apparatus is covered by a removable adhesive liner. Preferably, the adhesive liner may be made of any suitable material that is removable when the trim apparatus is ready for installation. Liners may, without limitation, be comprised of paper components and polymeric components, such as a polymeric film. In another embodiment, the adhesive liner extends beyond the boundary of the adhesive component, such as for example, about 3/16 of an inch past the boundary of the adhesive component.

In another embodiment, a method for manufacturing a window trim element is disclosed, said method comprising the steps: an elongated window trim blank having a front surface and an opposing back surface; and cutting at least one longitudinally extending groove on at least one surface of the blank using a blade. In a preferred embodiment, the blade comprises a stationary blade.

In another embodiment, a method for manufacturing a customizable window trim element is disclosed, said method comprising the steps; providing an elongated window trim blank having a front surface and an opposing back surface, and cutting at least one longitudinally extending groove on at least one surface of the blank. In a preferred embodiment at least one dimension of the resulting window trim apparatus may be reduced by tearing or breaking the window trim apparatus along at least one longitudinally extending groove. In a preferred embodiment, said at least one dimension of the resulting window trim apparatus may be reduced without using a blade to cut through or score said at least one groove.

The longitudinally extending groove or grooves of the disclosed window trim apparatus may be formed using a blade. In a preferred embodiment, the blade comprises a stationary blade. In another embodiment the grooves are made by means other than by an extrusion process, such as other than through the use of an extrusion die.

In another embodiment, the invention provides a method for manufacturing a window trim element comprising: forming an elongated window trim blank having a front surface and an opposing back surface; and cutting at least one longitudinally extending groove on at least one surface of the blank while the blank is at an elevated temperature.

In a further embodiment, the methods comprise cutting a plurality of longitudinally extending grooves (e.g., two, three, four, five or more grooves) using the same cutting method as used for the first groove.

In a preferred embodiment, the window trim blank is supported by a rotatable wheel during the cutting step. In a further preferred embodiment, the wheel is substantially round.

In another embodiment, the window trim blank is formed at least in part using an extrusion process. In another embodiment, the window trim blank is cooled before the cutting step.

In another embodiment, the method includes applying an adhesive component to the surface of the blank. In a further embodiment, the method includes applying a removable adhesive liner over the adhesive component. In still a further embodiment, the method includes applying a removable protective liner to the surface of the blank. Preferably, although not exclusively, the protective liner comprises a polymeric component.

In another embodiment, the invention provides an apparatus for producing window trim elements, the apparatus comprising: an extrusion assembly structured to form an elongated window trim blank from an extrudable polymeric material and a cutting assembly for cutting at least one longitudinally extending groove in said blank, wherein said groove is substantially parallel to at least one edge of said window trim blank. In a preferred embodiment, the cutting apparatus comprises at least one stationary blade. In another embodiment, the cutting assembly comprises a plurality of stationary blades. In still another embodiment, the cutting assembly comprises a rotatable wheel used to support the elongated window trim blank on one side of the blank while at least one longitudinally extending groove is made in the other side of the blank. In another embodiment the cutting assembly comprises a slick surface upon which at least a portion of one side of said blank is supported while at least one longitudinally extending groove is made in the other side of the blank. Preferably, said slick surface comprises a non-stick-component such as, without limitation, a TEFLON® or TEFLON®-like non-stick component applied to said surface.

The present invention may comprise, without limitation, any combination of elements or embodiments disclosed in this specification, including the claims. Other features and advantages of the invention will be apparent from the following detailed description and claims.

DETAILED DESCRIPTION OF THE INVENTION

The present invention relates to window trim with pre-cut grooves and methods for making and using same. The present invention provides an improved window trim apparatus in which at least one dimension of the trim may be easily varied by an installer. In certain embodiments this window trim comprises at least one longitudinally extending groove made by a method other than extrusion methods. Preferably the groove or grooves are made using a blade. In a particularly preferred embodiment a stationary blade is used to cut grooves in window trim elements, thereby providing window trim that is both easily customizable in the field and substantially smooth on the side opposite the grooves. The following description of the figures is drawn to additional currently preferred embodiments of the invention, which is not limited in any way thereby.

Figure 1:
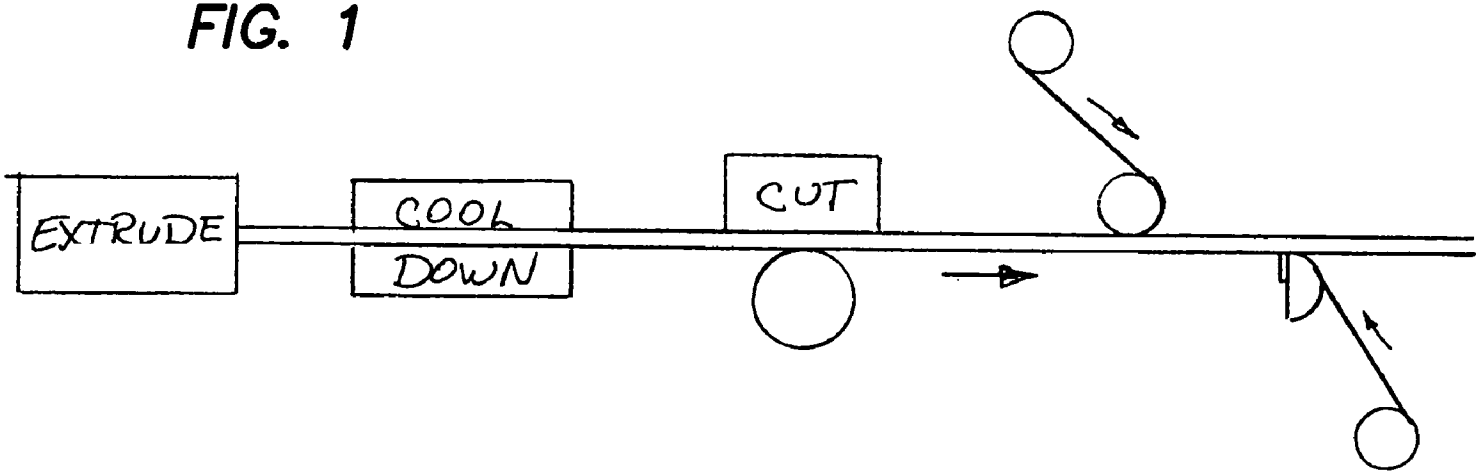
FIG. 1 is a schematic flow diagram of a method of making window trim in accordance with the present invention.

FIG. 1 is a schematic flow diagram of an exemplary method of making window trim in accordance with the present invention. An extrusion assembly 12 extrudes a window trim blank 13 at an elevated temperature. The window trim blank 13 is then cooled by submersion in water 14 and passed under a cutting assembly 15, which cuts at least one longitudinally extending groove in the front surface 1 of the window trim blank. When passed under the cutting assembly 15, the polymeric material 14 is supported by a rotatable wheel 16. Adhesive 7 is applied to the front surface 1, a removable adhesive liner 8 is applied over the adhesive 7, and a removable protective liner 10 is applied to the opposing surface 2.

Figure 2:
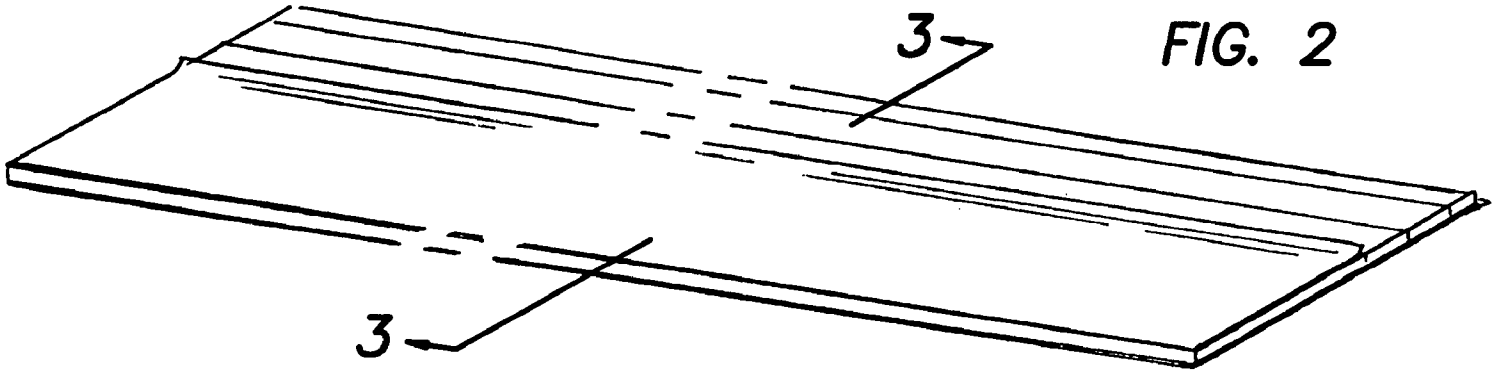
FIG. 2 is a diagram of a window trim apparatus of the present invention.

FIG. 2 an elevated diagram of a window trim apparatus according to the current invention, as viewed from the front surface 1. The front surface 1 comprises three longitudinally extending grooves 3. The window trim apparatus includes adhesive 7 on the front surface 1 between the distal edge 5 and the grooves 3, a removable adhesive liner 8 that covers the adhesive 7 and extends beyond the adhesive boundary 9.

Figure 3:
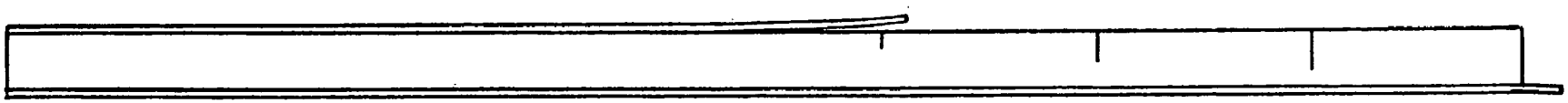
FIG. 3 is a cross-sectional diagram of a window trim apparatus of the present invention.

FIG. 3 is a perspective view of the window trim apparatus shown in FIG. 2, through a cross-section along axis 22. The window trim apparatus in FIG. 3 includes a front surface 1 and an opposing back surface 2. The front surface 1 comprises three longitudinally extending grooves 3 cut by a stationary blade. Each groove 3 is a different depth, with the grooves progressively deeper the closer they are to the proximal edge 6 of the window trim apparatus. The window trim apparatus in FIG. 3 includes adhesive 7 on the front surface 1 between the distal edge 5 and the first groove 3, a removable adhesive liner 8 that covers the adhesive 7 and extends beyond the adhesive boundary 9, and a removable protective liner 10 on the opposing back surface 2.

Figure 4A:
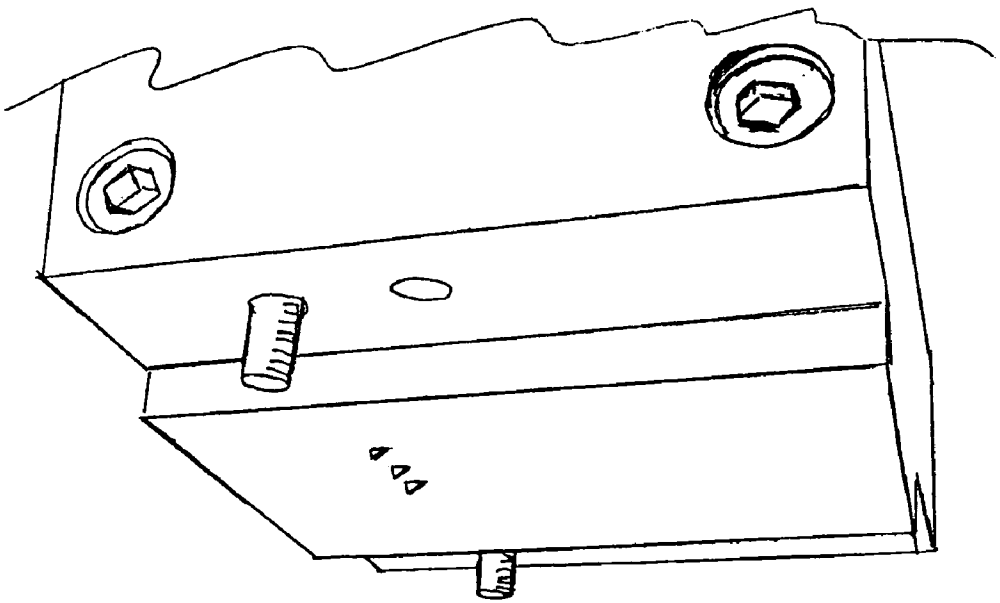
FIG. 4*a* is a diagram of a stationary blade assembly used to cut grooves in window trim in accordance with the present invention.

FIG. 4A is a diagram of a cutting assembly 15 that may be used to cut the longitudinally extending grooves 3 according to the invention. The cutting assembly 15 comprises knife blades 17, extending from a substantially planar surface 24, and a housing 18 that anchors the blades 17 and keeps them stationary. Each of the blades 17 extend from the surface 24 at a precisely defined length, in order to cut reproducible grooves 3 of different depths in the same window trim apparatus.

Figure 4:
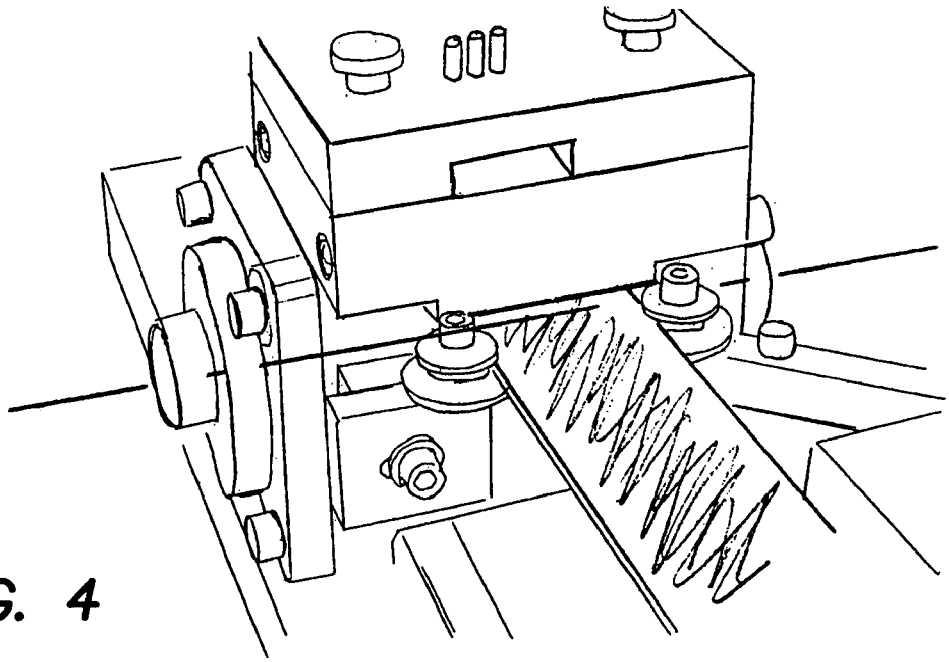
FIG. 4 is a diagram of the cutting assembly used in accordance with the methods of the invention.

FIG. 4 is a diagram of a cutting assembly 15 positioned over a window trim blank 13. Guide wheels 19 positioned at the edges of the window trim blank 13 keep the window trim blank from moving to one side or the other, so that the grooves cut by the stationary blades are substantially straight.

Figure 5:
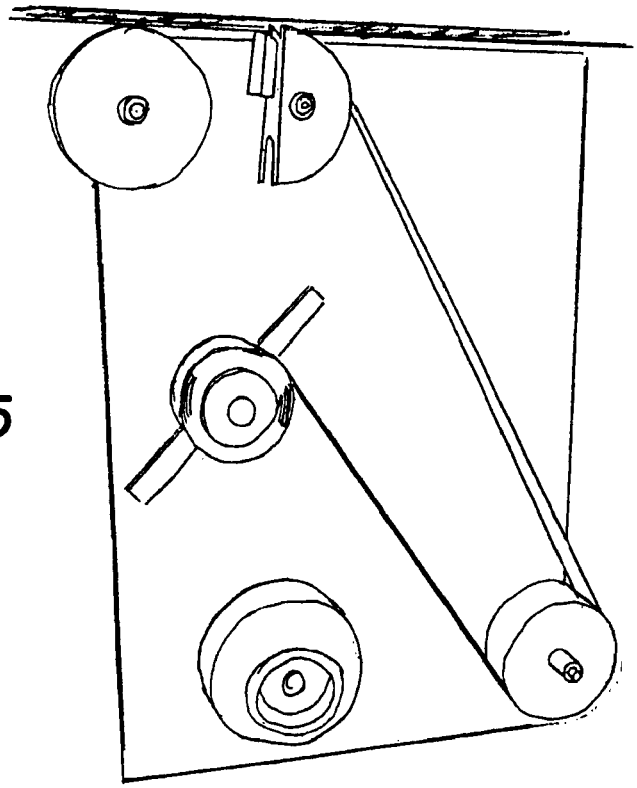
FIG. 5 is a diagram of an assembly used to apply a protective liner to the window trim in accordance with the present invention.

FIG. 5 is a diagram of a protective liner application assembly 20. The protective liner 10 is applied to the opposing back side 2 of the window trim blank 13.

The window trim of the present invention is preferably produced by extrusion of a polymeric material through a die in the preferred shape of the window trim being produced. The polymeric material may be any polymeric material suitable for use as window trim, including, but not limited to, polyvinyl chloride (PVC) and other plastics such as, without limitation, polycarbonate, polypropylene, or polyacrylate. The polymeric material may be substantially pure, or it may have other materials incorporated therein, including color components such as titanium dioxide. The polymeric material is typically extruded through the die at a temperature sufficient to make the polymeric material malleable. A preferred temperature for extruding PVC is 380° F. (193° C.).

After extrusion, the window trim may be cut with one more stationary blades. Preferably, the extruded window trim is cooled to a temperature that is cool enough to cut with a blade without creating shrink lines, but hot enough such that wear on the blades is minimized. A preferred temperature for extruding PVC is 200° F. (93° C.). The extruded window trim may be cooled by any appropriate methods, for example, exposure to air or water of a desired temperature. A preferred method is submerging in water.

When the grooves are made using one or more blades, the blades used to produce the window trim of the invention may be made of any material sufficiently strong to score the polymeric material of the window trim. Preferably, the blades are made from metal or a metal alloy that retain their edge while scoring large quantities of window trim. The blades may, for example, be made of stainless steel, or, preferably, a carbide alloy. Preferably, the blades are cut at an angle to enable the maximum lifetime for each blade, and to create deep scores while minimizing friction. In one embodiment, the blades may be submerged in water during use to lubricate and cool the blades.

In a preferred embodiment, the blades are held in place by housing. If more than one groove is desired, the number of blades corresponding to the number of desired grooves may be placed an appropriate distance from each other in the housing. If grooves of different depths are desired, the blades may extend from the planar surface of the housing by different lengths. Preferably, the housing holding the blades is oriented above the extruded window trim blank, which is then moved past the blades as they score the grooves into the front surface of the window trim (during scoring, the front surface is preferably oriented upwards). The window trim blank is supported from below by a circular wheel, which can rotate as the window trim blank moves past the blades. The use of such a wheel helps to prevent the back surface of the trim from being scratched during the scoring step. The wheel is preferably made from a material such as a metal or metal alloy (e.g., steel). The window trim is also preferably passed between guides (e.g., guide wheels or projections) to keep the trim in proper side to side orientation during the scoring operation, in order to keep the grooves substantially straight.

In one embodiment, the window trim blank may be scored successively, or serially, by the use of more than one cutting assembly positioned at different locations along the manufacturing line. By scoring the window trim in such a manner, it allows one cutting assembly to be replaced when the blades are dulled by the second or subsequent cutting assemblies without stopping other steps of production, or without wasting trim that would not get scored while new blades are put in place. For example, when a set of blades in a first cutting assembly needs to be replaced, a second cutting assembly containing blades in the same orientation may be placed over the trim, after which the first cutting assembly is removed.

In a preferred embodiment, the window trim of the present invention comprises an adhesive component on the front surface, which may be used to attach the trim to a window frame. The adhesive component may be applied in any conventional manner, and is preferably extruded (e.g., by a hot melt applier) onto the trim. The adhesive may be smoothed out (e.g., by a heated blade applier). A preferred ingredient of the adhesive component is rubber, preferably a vulcanized rubber. When using a rubber in an adhesive component, care should be taken to prevent disintegration of the adhesive component due to rubber tendency to break down in UV sunlight. Accordingly, one method of preventing such adhesive damage is to use an opaque additive in the window trim, and an adhesive liner. In one preferred embodiment, the opaque additive may comprise titanium dioxide.

After application of adhesive to the trim, a removable adhesive liner, preferably opaque, is applied, and the adhesive component may be cooled (e.g., using chilling bars). Preferably, the adhesive liner extends beyond the boundary of the adhesive so that it can be easily grasped by a person wishing to remove the liner.

In another embodiment, a removable protective liner is applied to the back surface of the window trim to protect it during the stages between manufacture and installation (e.g., packaging, shipping, local transport, etc.). Because the back surface of the trim is the part of the trim that is visible after installation, it is preferable that the back surface be substantially smooth and free of scratches and other defects. The protective liner may be any material that will adhere to the back surface of the trim and protect it from scratching, and which can be easily removed prior to installation. A preferred material for the protective liner is polyethylene film (e.g., 2 mil polyethylene with 0.5 mil acrylic).

What is claimed:

1. A polymeric window trim apparatus comprising: a substantially flat, elongated, extruded, polymeric window trim element having a front surface and an opposing back surface and at least one blade-formed, approximately V-shaped longitudinally extending groove on at least one such surface formed by a stationary blade after extrusion, wherein the shallowest depth of said at least one groove is about ⅓ the thickness of the trim strip, and wherein the polymeric window trim apparatus is structured to be reduced by tearing the window trim along at least one longitudinally extending groove without using a blade.

2. The polymeric window trim apparatus of claim 1 comprising at least two blade formed, approximately V-shaped longitudinally extending grooves of different depths.

3. A polymeric window trim apparatus comprising: a substantially flat, elongated, extruded, polymeric window trim element having a front surface and an opposing back surface and a plurality of blade formed, approximately V-shaped longitudinally extending grooves on at least one such surface formed by a stationary blade after extrusion, wherein each of the longitudinally extending grooves has a different depth, with the groove closest to a substantially parallel proximal edge having the greatest depth, and each groove successively further away from said edge being of progressively shallower depth, and with the shallowest depth being about ⅓ the thickness of the trim strip, and wherein the polymeric window trim apparatus is structured to be reduced by tearing the window trim along at least one longitudinally extending groove without using a blade.

4. The window trim apparatus of claim 3, wherein the longitudinally extending grooves are substantially straight and substantially parallel.

5. The window trim apparatus of claim 3, wherein the surface opposite to the longitudinally extending grooves is substantially smooth.

6. The window trim apparatus of claim 3, which comprises three longitudinally extending grooves, wherein the first longitudinally extending groove has a depth of about ⅔ the thickness of the window trim apparatus, wherein the second longitudinally extending groove has a depth of about ½ the thickness of the window trim apparatus, and wherein the third longitudinally extending groove has a depth of about ⅓ the thickness of the window trim apparatus.

7. The window trim apparatus of claim 3, which comprises three longitudinally extending grooves, wherein the first longitudinally extending groove is spaced about 1/7 of the width of the window trim apparatus from one edge of the window trim apparatus, wherein the second longitudinally extending groove is spaced about 2/7 of the width of the window trim apparatus from the same edge of the window trim apparatus, and wherein the third longitudinally extending groove is spaced about 3/7 of the width of the window trim apparatus from the same edge of the window trim apparatus.

8. The window trim apparatus of claim 3, which is about 1/16 of an inch thick.

9. The window trim apparatus of claim 3, which comprises three longitudinally extending grooves, wherein the first longitudinally extending groove is about 0.040 inches deep, wherein the second longitudinally extending groove is about 0.025 inches deep, and wherein the third longitudinally extending groove is about 0.015 inches deep.

10. The window trim apparatus of claim 3, which is about 1¾ inches wide.

11. The window trim apparatus of claim 3, which comprises three longitudinally extending grooves, wherein the first longitudinally extending groove is spaced about ¼ of an inch from one edge, wherein the second longitudinally extending groove is spaced about ½ of an inch from the same edge, and wherein the third longitudinally extending groove is spaced about ¾ of an inch from the same edge.

12. The window trim apparatus of claim 3, which comprises a polymeric composite material.

13. The window trim apparatus of claim 12, which comprises polyvinyl chloride (PVC).

14. The window trim apparatus of claim 3, which comprises a protective liner on the side opposite to the longitudinally extending grooves.

15. The window trim apparatus of claim 3, which comprises adhesive located between at least one longitudinally extending groove and one edge of the window trim apparatus.

16. The window trim apparatus of claim 15, wherein the adhesive is 0.001-0.20 inches thick.

17. The window trim apparatus of claim 15, wherein the adhesive comprises vulcanized rubber.

18. The window trim apparatus of claim 15, wherein the adhesive is covered by removable adhesive liner.

* * * * *